US009644376B2

(12) United States Patent
Stanaland

(10) Patent No.: US 9,644,376 B2
(45) **Date of Patent: *May 9, 2017**

(54) TANK FARM SYSTEM

(71) Applicant: Martin Stanaland, Nacogdoches, TX (US)

(72) Inventor: Martin Stanaland, Nacogdoches, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/628,327

(22) Filed: Feb. 23, 2015

(65) Prior Publication Data

US 2015/0167310 A1 Jun. 18, 2015

Related U.S. Application Data

(63) Continuation of application No. 13/968,194, filed on Aug. 15, 2013, now Pat. No. 8,985,276, which is a (Continued)

(51) Int. Cl.

| | |
|---|---|
| ***E04G 27/00*** | (2006.01) |
| ***E04F 11/00*** | (2006.01) |
| ***E04F 11/04*** | (2006.01) |
| ***E01C 9/00*** | (2006.01) |
| ***E01C 15/00*** | (2006.01) |

(Continued)

(52) U.S. Cl.

CPC ..... *E04F 11/002* (2013.01); *E01C 9/00* (2013.01); *E01C 9/08* (2013.01); *E01C 15/00* (2013.01); *E04B 1/34336* (2013.01); *E04B 1/34347* (2013.01); *E04F 11/04* (2013.01); *E04F 11/06* (2013.01); *E04F 11/062* (2013.01); *E04F 11/1041* (2013.01); *E04F 11/112* (2013.01); *E04G 27/00* (2013.01); *E04H 7/00* (2013.01)

(58) Field of Classification Search

CPC ..... E01C 1/52; E01C 1/56; E01C 1/58; E01C 15/00; E01C 9/083; E04F 11/062; E04F 11/04; E04G 27/00

See application file for complete search history.

(56) References Cited

U.S. PATENT DOCUMENTS 505,343 A * 9/1893 Austin ..... E06C 1/345 182/156
1,363,418 A * 12/1920 Jacobs ..... E04F 11/025 182/194

(Continued)

FOREIGN PATENT DOCUMENTS

GB 2131475 6/1984

OTHER PUBLICATIONS

ABTECH Safety, Tuff Step, 2 pages, 2008.

*Primary Examiner* — Alvin Chin-Shue

(74) *Attorney, Agent, or Firm* — Rao DeBoer Osterrieder PLLC; John DeBoer

(57) ABSTRACT

A tank farm system that includes a tank configured to hold a volume of fluid; a barrier constructed at least partially around the tank; and a portable pathway disposed on the barrier. The portable pathway further includes a pliable frame member; a row of mating holes disposed on each side of the pliable frame member; a set of steps coupled to the pliable frame member; wherein one or more of the set of steps is coupled to the pliable frame member with a mount that aligns with the row of mating holes on each of the corresponding sides of the pliable frame member.

12 Claims, 9 Drawing Sheets

Related U.S. Application Data continuation of application No. 12/924,591, filed on Sep. 30, 2010, now Pat. No. 8,522,921.

(51) Int. Cl.

| | |
|---|---|
| ***E04F 11/06*** | (2006.01) |
| ***E04H 7/00*** | (2006.01) |
| ***E01C 9/08*** | (2006.01) |
| ***E04B 1/343*** | (2006.01) |
| ***E04F 11/112*** | (2006.01) |
| ***E04F 11/104*** | (2006.01) |

(56) References Cited

U.S. PATENT DOCUMENTS 2,708,543 A * 5/1955 Matich ..... E06C 1/345 182/196
3,464,516 A 9/1969 Sylvester
4,041,722 A * 8/1977 Terlesky ..... F17C 3/022 165/45
4,951,434 A * 8/1990 Schmidt ..... E04F 11/025 52/185
4,959,935 A * 10/1990 Stob ..... E01D 15/24 182/156
5,244,058 A * 9/1993 Carlson ..... E06C 9/04 182/150
5,626,440 A * 5/1997 Greene, Jr. ..... E02B 3/20 182/88
6,467,234 B1 * 10/2002 Marshall ..... E04F 11/00 182/194
7,946,084 B2 * 5/2011 Gibson ..... E04F 11/1043 52/182
2002/0046543 A1 * 4/2002 Neuleib ..... E04D 15/00 52/749.12
2007/0199258 A1 * 8/2007 Reeves ..... E04F 11/0255 52/183
2009/0205906 A1 * 8/2009 Schwoerer ..... E04F 11/0255 182/92
2013/0000231 A1 * 1/2013 Greaves ..... E04D 13/12 52/183

* cited by examiner

TANK FARM SYSTEM

CROSS-REFERENCE TO RELATED APPLICATIONS

This application is a continuation of U.S. patent application Ser. No. 13/968,194, filed on Aug. 15, 2013, which is a continuation of U.S. patent application Ser. No. 12/924,591, filed on Sep. 30, 2010. The disclosure of each application is incorporated by reference herein in entirety for all purposes.

STATEMENT REGARDING FEDERALLY SPONSORED RESEARCH OR DEVELOPMENT

Not applicable.

BACKGROUND OF THE DISCLOSURE

Field of the Disclosure

Embodiments disclosed herein generally relate to an apparatus for creating a traversable path over a surface. Specific embodiments relate to a portable apparatus configured to conform to a surface with one or more varying contours, and methods and systems for the same. Other embodiments relate to a portable apparatus having independently adjustable steps movingly connected to a frame member.

Background

There are many different types of ladders and stairways presently used for residential, recreational, or industrial purposes, such as a conventional folding stepladder or a rope ladder, with some of these ladders also having adjustable steps. Some stairways are heavy-duty and/or well-built in order to provide a maximum level of durability or safety. Heavier stairways, usually comprising reinforced concrete or large metal grid-like structures, are used in construction or industry and are intended as permanent, long-life climbable structures. These stairways are quite heavy, cost-prohibitive, and the manufacture, transportation, and/or installation of such stairways are extremely difficult tasks. Because these stairways are rigid, one-piece, and difficult to move, there is no practicability in moving them once they are positioned in place. As such, these stairways also lack flexibility. Other stairways, or even walkways, are lighter and portable in order to provide some flexibility, but these are weak or flimsy, and also susceptible to damage from the surrounding environment.

One industry where stairways are used routinely is the petrochemical industry. Conventional stairways, ladders, walkways, etc. are used en mass in, for example, a petrochemical plant 103. The petrochemical plant 103, partially illustrated in FIG. 1A, will have any number of operations ongoing throughout a typical day, which includes bulk storage of liquid products and intermediates. Liquids like these are typically stored in large tank(s) 105, and the location of one or more of these tanks 105 is commonly referred to as a "tank farm" 155.

These storage tanks are often fitted with one or more nozzles, valves, etc., which are subsequently connected with associated piping (as needed) so that the fluids are transferable in and out of the tank 105. Because the storage tanks have these openings, the tanks 105 are susceptible to leaking. As such, there are typically rules and regulations established by governing bodies (e.g., OSHA) that require safety systems to be put in place around tanks or tank farms in case there is a leak. One way to ensure safety in the event of a leak is to construct a barrier 124 that surrounds the tank 105 in entirety, which usually entails the barrier 124 establishing a leak-proof perimeter around the tank farm 155.

FIG. 1B illustrates a typical man-made barrier 124B formed around tank 105, the size (i.e., height, volume, area, etc.) of which is generally proportional to a hypothetical predetermined maximum amount of fluids that may potentially leak from one or more of the tanks 105. The problem with constructing barriers around areas such as the tank farm 155 is that they hinder ingress and egress to the tanks 105. For example, it is often the case that the tank 105 will be located near a distribution point A where, for example, a supply truck 115, rail car, etc. will fluidly connect to the tank 105 in order to deliver or receive fluids. A user (e.g., operator, driver, laborer, etc.) 111 must manually turn a valve 113 located on or adjacent the tank, such as at point B, in order for the fluids to flow to/from the tank 105.

Accordingly, climbable structures, such as hardened stairway 101, are fitted to or over the barrier 124 so that the tank farm 155 may be accessed. The problem with hardened stairway 101 is that stairways of this nature are fixed in place. In addition, stairways like this are expensive to manufacture and install so there is usually only a single stairway placed onto the barrier 124. Because the tank farm 155 is only meant to be accessible via the stairway 101, the user 111 must walk all the way over to the stairway 101, which is highly inconvenient and time consuming.

A pathway to get from point A to point B shown in FIG. 1B, as indicated by pathway arrows 107, illustrates this inconvenience. In order for the user 111 to perform certain functions, such as to turn the valve 113 to allow storage fluids to be transferred to/from truck 115, the user 111 must walk all the way around barrier 124B in order to get from point A to point B.

While this is an inconvenience in itself for the barriers 124 and 124B, it is even more problematic for climbable structures that are not intended for climbing, such as barrier 124C illustrated in FIG. 1C. As shown, to get from point A to point B using stairway 101 the operator 111 would have to walk around the barrier 124C, use the stairway 101, and walk back around tank 105 in order to get to point B (e.g., location of valve 113, nozzle, etc.). However, because of this inconvenience, operators 111 eventually start to climb or tread over barrier 124C, which eventually leads to wearing down and/or complete erosion of at least a portion of the barrier 124C at the location where this occurs. This causes the barrier 124C to have a breach 125 that is, for example, a severe safety hazard, illegal, and/or subject to fines and penalties.

A similar effect may be found in areas, such as coastlines, beaches, or other land areas immediately adjacent a body of water 170, where sand dunes 124D or man-made berms are created to protect inland shorelines and structures, as illustrated in FIG. 1D. The dunes and/or berms prevent erosion and other damage caused by tidal flows or flooding. To allow beach goers 111 or other users to travel to and from the beach, residents or government entities typically construct hardened stairways (e.g., piers, etc.) 101D that cross over and/or bridge the dunes 124D.

However, like the barrier 124C previously described, beach goers and users 111 become complacent as a result of the inconvenience caused by sporadic placement of stairways 101D over vast distances, and will instead start making paths along the dunes, berms, etc. themselves. The continual treading on the dunes and berms eventually wears them away, leading to a breach 125 that becomes severely problematic when high tides or flooding waters occur.

There are other areas where a user or operator has need to traverse or walk on contoured surfaces, such as rooftop 117. As shown in FIG. 1E, user 111 (e.g., property owner, carpenter, repairman, maintenance man, laborer, etc.) is performing a job on rooftop 117, which as a result of the angled surface, is an extremely unsafe working condition. As shown, user 111 is presented with difficult walking areas that easily lead to slip and falls from the roof 117, which can cause severe injury and death.

As a result, there is a tremendous need for an apparatus to provide a pathway that is easy to manufacture and operate, cost-effective, and multifunctional. There is a great need for a portable apparatus that is easily and quickly movable between various locations, but can be securely positioned in order to provide a readily navigable and traversable pathway.

There is a need for a portable pathway that can be easily positioned in areas to prevent damage to barriers and other comparable structures, without affecting barrier integrity. There also remains a continuing unmet need for an apparatus that not only provides a path, but also provides adjustment devices that allow the apparatus to be used effectively on any contoured surface.

SUMMARY OF DISCLOSURE

Embodiments disclosed herein provide for a tank farm system that may include a tank configured to hold a volume of fluid; a barrier constructed at least partially around the tank; and a portable pathway disposed on the barrier. The pathway may include a pliable frame member; a row of mating holes disposed on each side of the pliable frame member; and a set of steps coupled to the pliable frame member. One or more of the set of steps may be coupled to the pliable frame member with a mount that aligns with the row of mating holes on each of the corresponding sides of the pliable frame member.

At least one step of the set of steps may include an adjustment mechanism. The portable pathway may include at least one securing element coupled with the pliable frame member. The securing element may be configured to secure the portable pathway to the barrier.

At least one of the set of steps may include galvanized metal. The barrier may include a man-made earthen surface.

The barrier may include a first angled surface with respect to a horizontal. There may be a second angled surface with respect to the horizontal. The portable pathway may be disposed or otherwise positioned at least partially on the first angled surface and/or the second angled surface.

The barrier may include a crest. The adjustment mechanism may include a first linking member movingly connected with a second linking member.

The portable pathway may include a non-adjustable step. The position of the pathway on the barrier may result in the non-adjustable step being proximate to a barrier crest.

Other embodiments of the disclosure pertain to a tank farm system with improved ingress and egress that may include a tank configured to hold a volume of fluid; a barrier proximate to the tank, the barrier comprising a first surface contour and a second surface contour; and a portable pathway configured to conform to the first surface contour and the second surface contour. The pathway may include a frame member; at least one step; and a mount for movingly coupling the at least one step to the frame member.

The frame member may be pliable. The portable pathway may include a plurality of independently adjustable steps coupled thereto. The barrier may include a man-made earthen surface. The first surface contour may include a first angled surface with respect to a horizontal. The second angled contour may include a second angled surface with respect to the horizontal. The portable pathway may be disposed at least partially on the first angled surface and/or the second angled surface.

The portable pathway may be configured with an equal amount of steps disposed proximate to each of the first angled surface and the second angled surface. The portable pathway may include a non-adjustable middle step disposed between the steps disposed proximate to the first angled surface and the second angled surface.

The first angled surface may be at an angle in the range of about 20 to about 70 degrees with respect to the horizontal. The second angled surface may be at an angle in the range of about 20 to about 70 degrees with respect to the horizontal.

The portable pathway may include a row of mating holes on a first and second side of the pathway. There may be connectors, which may be configured for connecting each of the respective mounts to the pathway via insertion into the desired mating holes.

Yet other embodiments of the disclosure pertain to a tank farm system that may include a tank; a barrier constructed at least partially around the tank; and a portable pathway disposed on the barrier. The pathway may include a pliable frame member; a set of steps; and a plurality of mounts. One or more of the mounts may be configured to couple a respective step to the pliable frame member. At least one of the set of steps may be independently movable along a length of the pliable frame member.

The barrier may include a man-made earthen surface. There may be a first angled surface with respect to the horizontal. There may be a second angled surface with respect to the horizontal. The portable pathway may be disposed or otherwise positioned at least partially on the first angled surface and/or the second angled surface.

The portable pathway may be configured with an equal amount of steps positioned on the first angled surface and the second angled surface. The portable pathway may include a non-adjustable middle step disposed between the steps on the first angled surface and the second angled surface. The first angled surface may be at an angle in the range of about 20 to about 70 degrees with respect to the horizontal. The second angled surface may be at an angle in the range of about 20 to about 70 degrees with respect to the horizontal. One or more of the plurality of independently adjustable steps may include a first linking member movingly engaged with a second linking member. One or more of the plurality of independently adjustable steps may include a horizontal member pivotably coupled to a respective mount.

The system may include a plurality of tanks. The barrier may be a man-made earthen berm. There may be a pipe, pipeline, etc. that extends from one of the plurality of tanks through the barrier.

The portable pathway may include a row of mating holes disposed on each side of the pliable frame member. One or more of the set of steps may be coupled to the pliable frame member with the respective mount that aligns with the row of mating holes on each of the corresponding sides of the pliable frame member.

The portable pathway may include a second set of steps. The set of steps may be coupled to the pliable frame member in a first orientation direction. The second set of steps may be coupled to the pliable frame member in a second orientation direction.

The portable pathway may include a non-adjustable step disposed between the set of steps and the second set of steps.

Other aspects and advantages of the disclosure will be apparent from the following description and the appended claims.

DETAILED DESCRIPTION

Figure 1A:
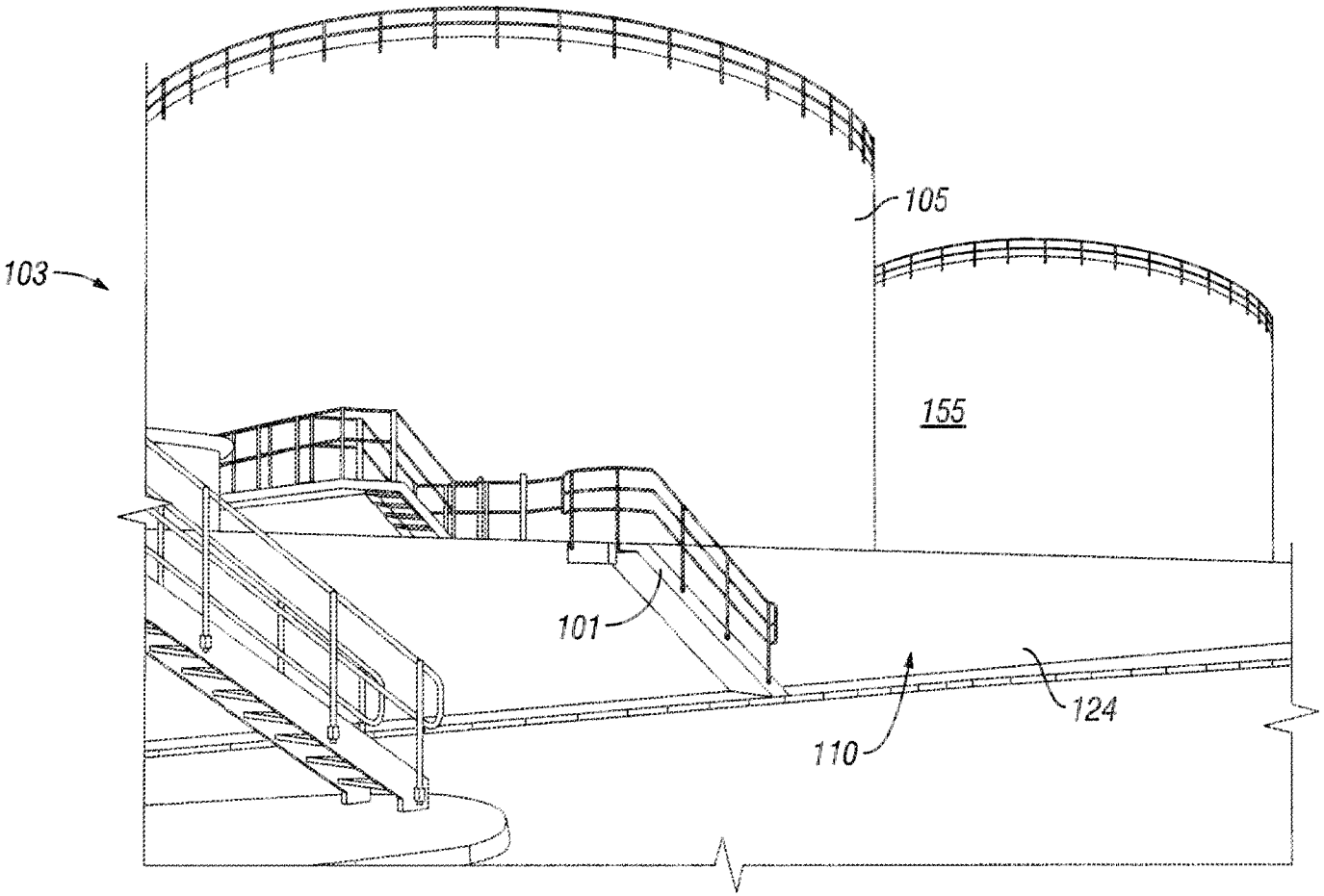
FIG. 1A PRIOR ART
FIGS. 1A-1D show conventional ladders used to provide paths over surfaces and barriers.
Figure 1B:
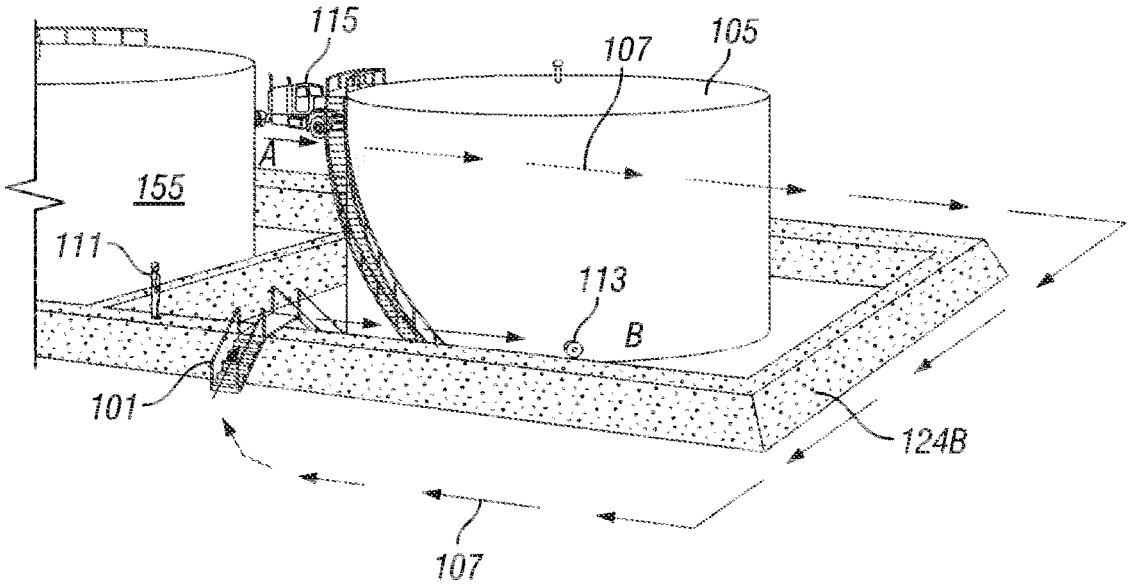
FIG. 1B PRIOR ART
Figure 1C:
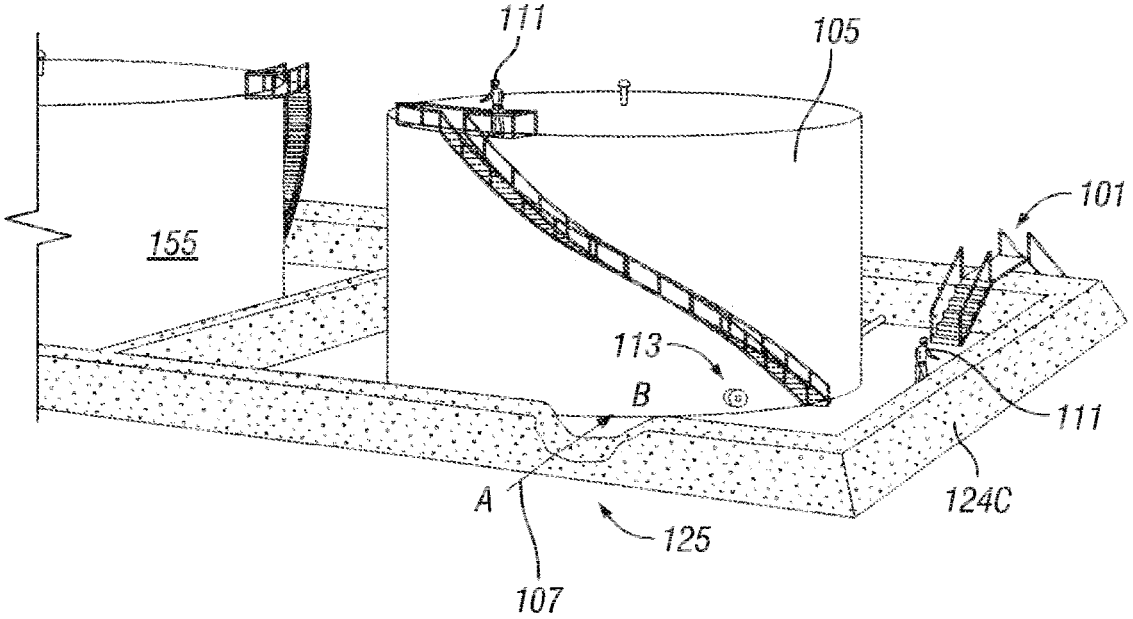
FIG. 1C PRIOR ART
Figure 1D:
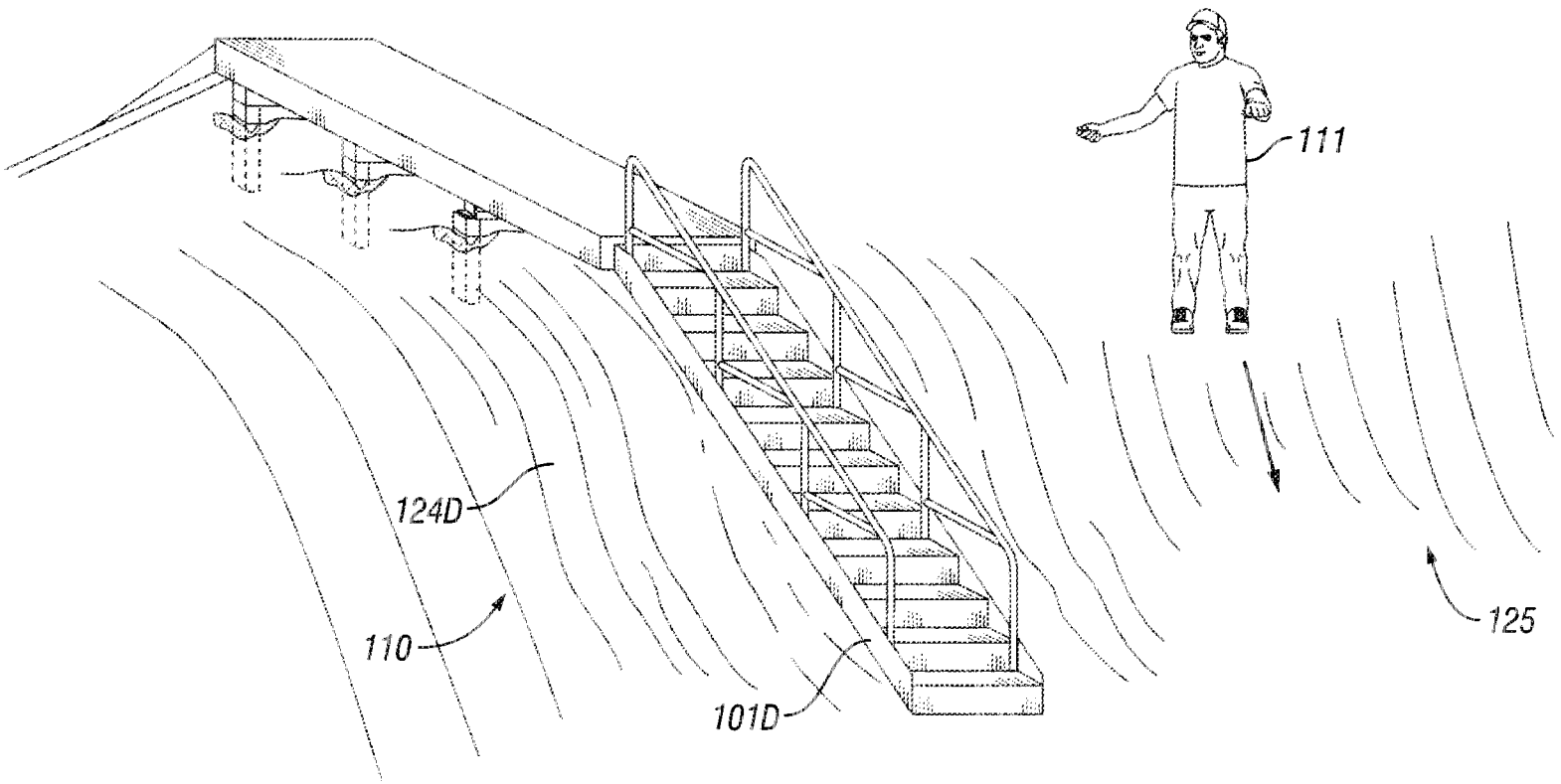
FIG. 1D PRIOR ART
Figure 1E:
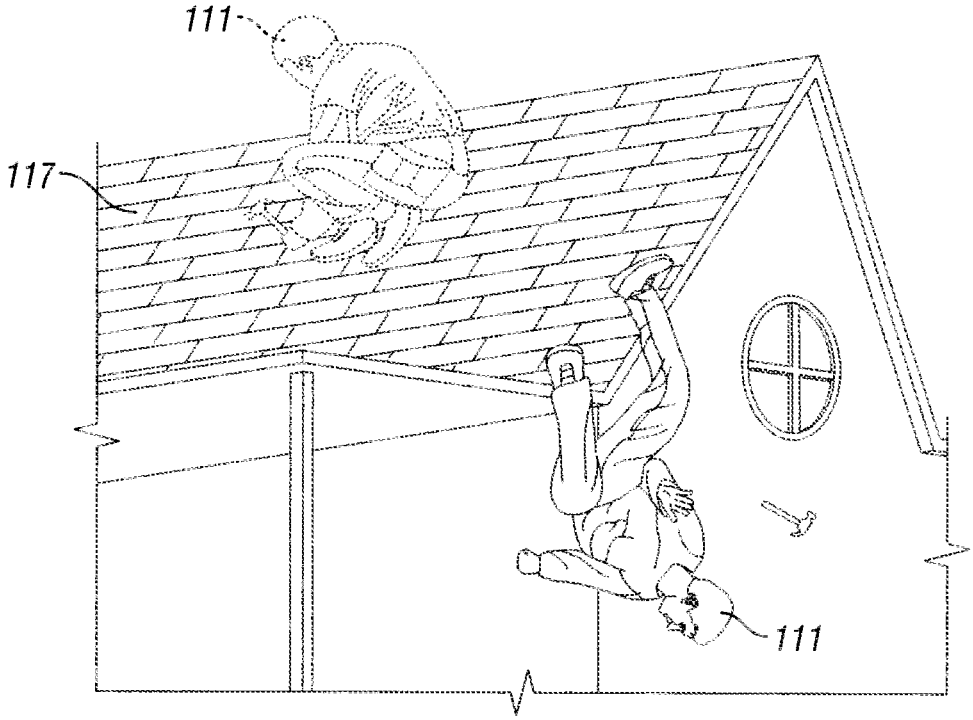
FIG. 1E PRIOR ART
FIG. 1E show conventional roofing operations that lack an easily traversable path.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," "front," "back," etc., are used for convenience in referring to the accompanying drawings. In general, "above," "upper," "upward," etc. refer to a direction toward the Earth's surface, but is meant for illustrative purposes only, and the terms are not meant to limit the disclosure.

Figure 2:
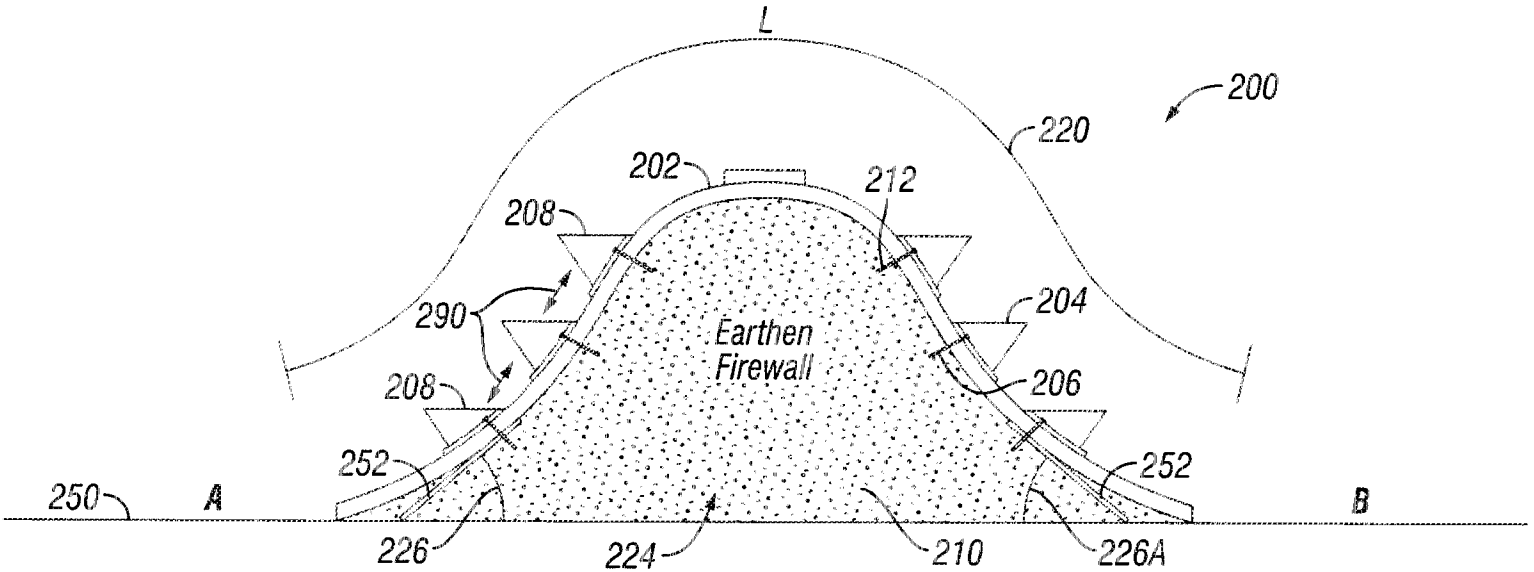
FIG. 2 shows a side perspective view of a portable pathway apparatus disposed on a surface, in accordance with embodiments of the present disclosure.

Referring now to FIG. 2, a side perspective view of a portable pathway apparatus 200 disposed on a surface according to embodiments of the present disclosure, is shown. The apparatus 200 may be used to provide (e.g., present, create, etc.) a safe and easily navigable or traversable path over a surface 210, which may be an otherwise difficult-to-cross or untraversable surface. The placement and/or use of the apparatus 200 may be temporary or long-term, as may be desired.

The portable apparatus 200 may be constructed of a number of interconnected components and subcomponents. Any of the components or subcomponents may be constructed of materials, such as, steel, aluminum, rubbers, composite plastics, wood, or combinations thereof. The portable apparatus 200 may include a component that includes a pliable frame member 202, which may have an associated length, L, and width (not shown). In some embodiments, the length of the frame member 202 may be in the range of about 4 to 8 feet, and the width may be in the range of about 1 to 4 feet. In other embodiments, the length and the width may be determined by whatever requirements need to be met in order to provide a traversable pathway; however, the length and width of the frame member 202 are not meant to be limited, and as such, may be any length and/or width whatsoever.

The pliable frame member 202 may be made of a durable material configured to withstand extreme environments, such as weather conditions, continuous usage, heavy wear-and-tear, etc. Although the apparatus 200 may just as well include a frame member of a rigid construction, such as one or more connected steel pieces, the portable pathway apparatus 200 may generally be considered to have a one piece pliable frame member 202 configured such that the apparatus 200 may readily conform to contours of the surface 210 where the apparatus 200 may be placed thereon.

Figure 4:
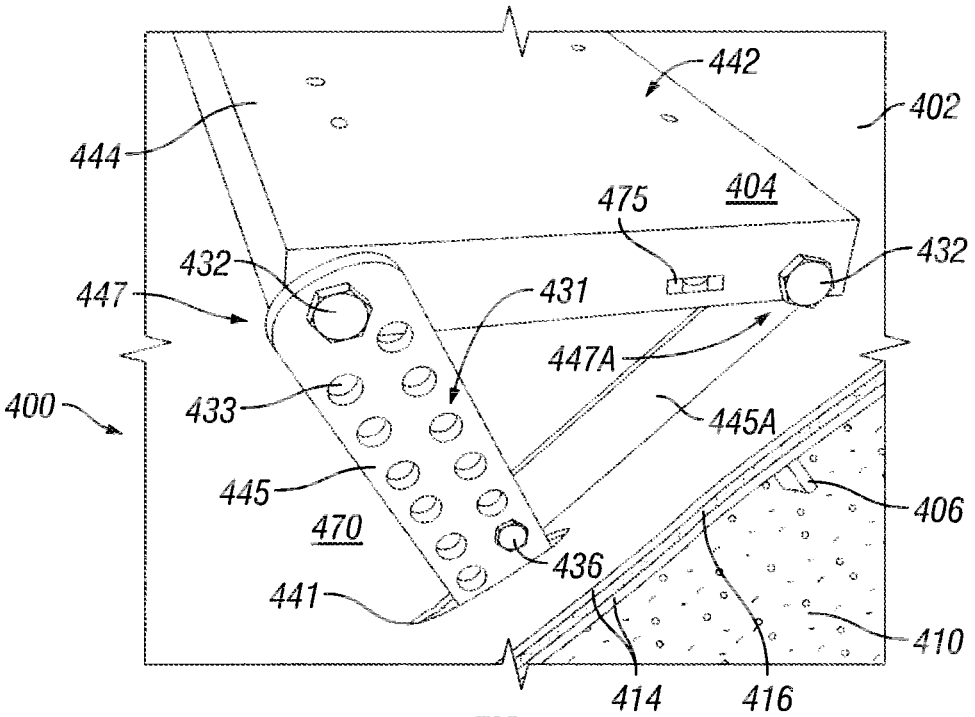
FIG. 4 shows a portable pathway apparatus having a step adjustably connected thereto, in accordance with embodiments of the present disclosure.

Accordingly, the pliable frame member 202 may include, for example, one or more solid, one-piece layers of rubber (414, FIG. 4). In an embodiment, the one or more layers of rubber may be reinforced with at least one strand of nylon, steel, etc. (not shown) interwoven, with one or more layers connectively stacked upon additional layers, and so on. However, the type of material that makes up the pliable frame 202 is not meant to be limited, and could be other materials as known to one of skill in the art, such as elastomers, nylon, etc.

The portable apparatus 200 may include "green" technology because the apparatus may be manufactured and/or put together from recycled materials. For example, the pliable frame member 202 may be made from old rubber tires or other previously used rubber materials. As such, the portable apparatus 200 may provide a synergistic effect of preventing damage to surfaces 210, while also reducing waste materials.

As mentioned, the pliable frame member 202 may thus include physical properties associated with at least some durability and toughness, but also flexibility and conformability. The frame member 202 may include at least one step 204 sturdily and/or adjustably connected thereto, as well as at least one securing element 206 that may be coupled with the pliable frame member 202.

The at least one securing element 206 may be configured to secure the portable pathway 200 to the surface 210. For example, the securing element 206 may be a solid-metal, spikeable structure connected to the bottom of the frame member 202 that may be easily insertable into soft surfaces, such as the ground. However, the type of securing element 206 is not meant to be limited, and could be other devices, such as rubber spikes, grommets, double-sided tape or other adhesives. Thus, this type of securing element 206 may be particularly useful when a spikeable structure is not suitable, such as when the surface 210 is hardened, like concrete, or when it is preferred that the surface 210 is not damaged by insertable features, such as a rooftop.

In addition to a single step 204, there may be one or more additional steps 208 connected to the pliable frame member 202, such that the pathway apparatus has a plurality of steps 204 and 208. In some embodiments, any of the steps 204 and/or 208 may be independently adjustable, while in other embodiments each one of the steps 204 and 208 may be independently adjustable. There may be a plurality of steps 204, 208 spaced equidistantly from one another, as indicated by spacing arrows 290, however, it is not necessary that this is the case for each and every step. As such, some steps 204, 208 may be spaced equidistantly from others, while other steps 208 are spaced apart by varying distances.

Referring briefly to FIG. 4, a portable pathway apparatus having a step 404 adjustably connected thereto according to embodiments disclosed herein, is shown. When a user, for example, walks on the portable pathway 400 placed over surface 410, the user may have an easier time walking with the presence of one or more of the steps 404 connected to a frame member 402. The pathway 400 may be secured to the surface 410 by inserting one or more securing elements 406 disposed on the underside of frame 402 into the surface 410.

As shown in FIG. 4, step 404 may include a flat, horizontal member 444 configured for the user to step thereupon. In an embodiment, the horizontal member 444 may have a width comparable to the width of the pliable frame member (not shown). To provide rigidity, the step 404 may be constructed partially or entirely from a strong, sturdy material, such as galvanized metal. However, the construction of the step 404 is not meant to be limited by embodiments described herein, and could just as well be other materials previously disclosed.

The step 404 may include a layer 442 disposed on the horizontal member 444, with the layer 442 configured to, for example, prevent corrosion, prevent accidental slippage, provide improved traction, friction, etc. The layer 442 may be a topical surface that is textured or coated with a pattern, coating, or other comparable substance to provide a non-slip surface.

The step 404 may include a number of other subcomponents, including subcomponents that may provide the step 404 with the ability to adjustably move with respect to the pliable frame 402. For example, the step 404 may include the aforementioned horizontal member 444 connected with various linking members 445. The one or more linking members 445 may be securely, but movingly attached to the horizontal member 444. In addition, a first linking member 445 may be securely, but movingly attached to a second linking member 445A. Although linking members 445 and 445A are illustrated with structural differences, the linking members may just as well be substantially similar. In some embodiments, there may be a first linking member 445 and second linking member 445A connected on a first side (as shown) of the horizontal member 444, and there may be other linking members 445, 445A connected on a second side (not shown) of the horizontal member 444.

Linking members 445 and 445A may include a number of configurations and variations. For example, linking member 445 may include one or more apertures 433, while linking member 445A has no apertures 433. The apertures 433 may be used as passages through which pins 436 may be disposed therein. The pins 436 may be, for example, bolts (with nuts), screws, nails, or other fastener devices that may be used to fix the relationship of the linking members 445 and 445A, such that the level of the step 404 may be adjusted to and secured in its desired position. In one embodiment, the desired position of the step 404 may include one or more steps adjusted until the horizontal member 444 is substantially planar to a horizontal plane (250, FIG. 2).

The linking members 445 and 445A may connect together as part of an adjustment mechanism 470. As such, the adjustment mechanism 470 may include the first linking member 445 movingly coupled with the second linking member 445A. As mentioned, the pin 436 may be inserted into one of the apertures 433 of the linking member 445, and also through an aperture (not shown) of linking member 445A. Any of the linking members 445 and 445A may have ends 447 and 447A, respectively, connected with horizontal member 444. The ends 447 and/or 447A may be connected to the horizontal member 444 with a pin 432 inserted through corresponding apertures (not shown). There may be an opening 441 disposed in the frame member 402 that may be used to accommodate upward and/or downward movement of any of the linking members 445.

Although the adjustment mechanism 470 is depicted in FIG. 4 at least partially including aligned apertures with the insertable pin 436, the adjustment mechanism 470 is not meant to be limited, and could be other arrangements, such as the linking members 445 and 445A slidingly and/or telescopingly engaged.

Accordingly, although not shown here, the first linking member 445 may have a slot, whereby pin 436 may be loosened so that the linking member 445 and linking member 445A may be slidably adjusted and/or moved with respect to each other. Once the desired adjustment is made, the pin 436 may be secured, such that the linking member 445 and 445A are secured with each other and no longer slidably movable. In order to obtain the desired level of surface 444, a carpenters level may be used as a guide or indicator to adjust the step 404 to its desired position. In an exemplary embodiment, an indicator 475 may be disposed on one or more of the steps 404 that may be used to indicate level.

Referring again to FIG. 2, there may be additional securing elements 212, and any of the additional securing elements 212 may be coupled or integral with the pliable frame member 202. Alternatively, any of the steps 204 and 208 may be configured for a corresponding securing element 206 and/or 212 to be coupled therewith. In one embodiment, any of the securing elements 206 and 212 may be configured to secure the portable pathway 200 to the surface 210, while in other embodiments each and every one of the securing elements 206 and 212 may be configured to secure the portable pathway 200 to the surface 210.

The surface 210 upon which the pathway apparatus 200 may be applied against may be any kind of surface that may at some point require walking upon or traversing. As illustrated, the surface 210 may be a generally flat earthen surface 224, such as the ground. The earthen surface 224 may also be contoured, such as, for example, a mound, a rolling hill, the side of a hill, etc. As shown in FIG. 2, the earthen surface 224 may be contoured with one or more surfaces 252 that are angled with respect to a horizontal plane 250. As such, the apparatus 200 may be used on surfaces 224 that have one or more contours or angles 226, 226A associated with one or more surfaces 252.

In some embodiments, the earthen surface 224 may be a permanent or temporary barrier created, for example, to encompass a tank farm. In other embodiments, the earthen surface 224 may be a berm or a dune used, for example, to protect inland shoreline areas from tidal flows or flood waters.

As such, it would be apparent to one of skill in the art that the apparatus 200 may be used on the surface 210 that may be thought of as a naturally existing barrier, as well as a man-made barrier. Moreover, it would be apparent to one of skill in the art that the apparatus is not limited to the surface 210 that may be earthen in nature, such as the dune or a hillside, but the apparatus 200 could just as well be used on made-made surfaces, such as steel barriers, concrete barriers, rooftops, etc.

Figure 3A:
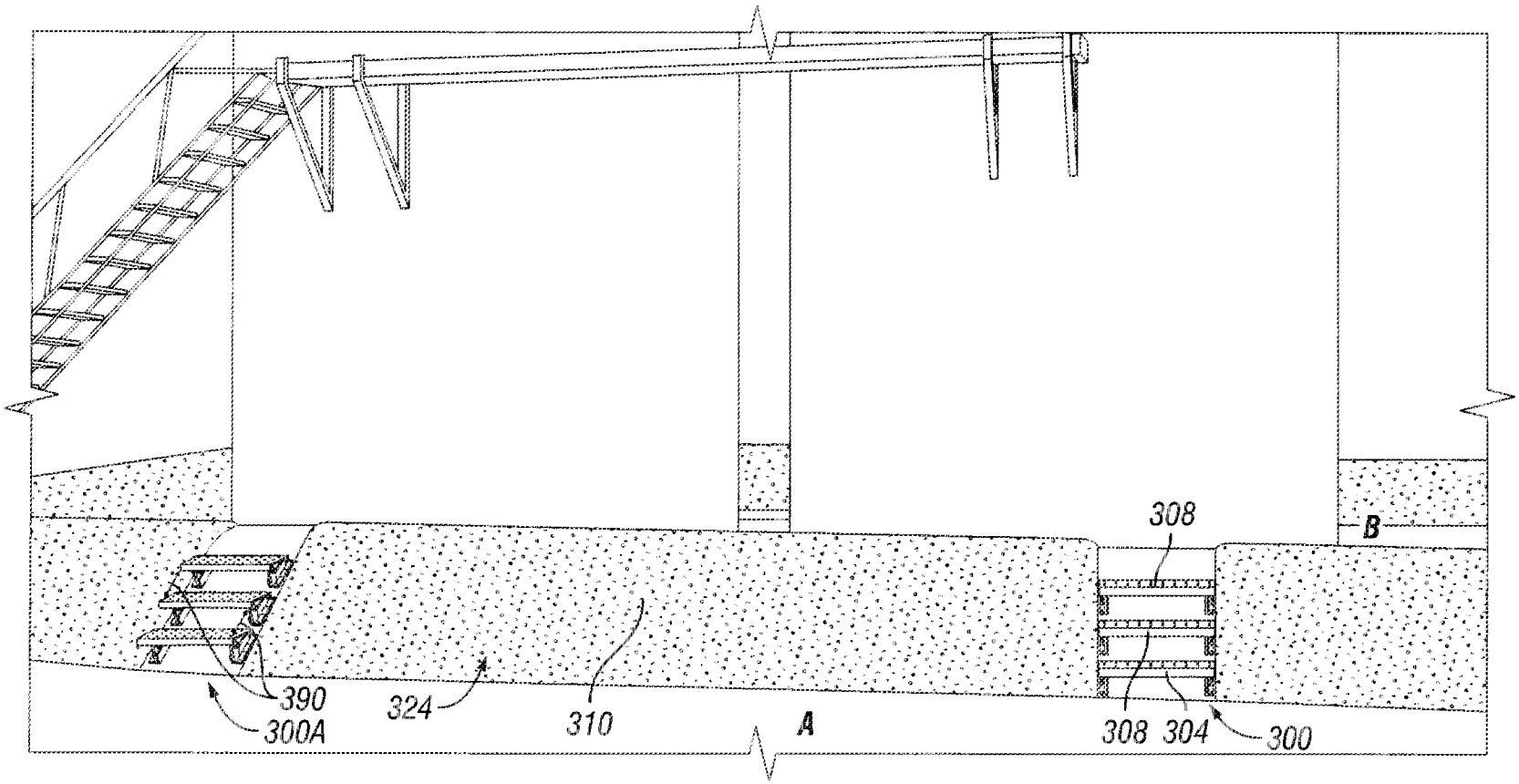
FIGS. 3A and 3B show a front view and side perspective view, respectively, of a portable pathway apparatus disposed on a surface, in accordance with embodiments of the present disclosure.
Figure 3B:
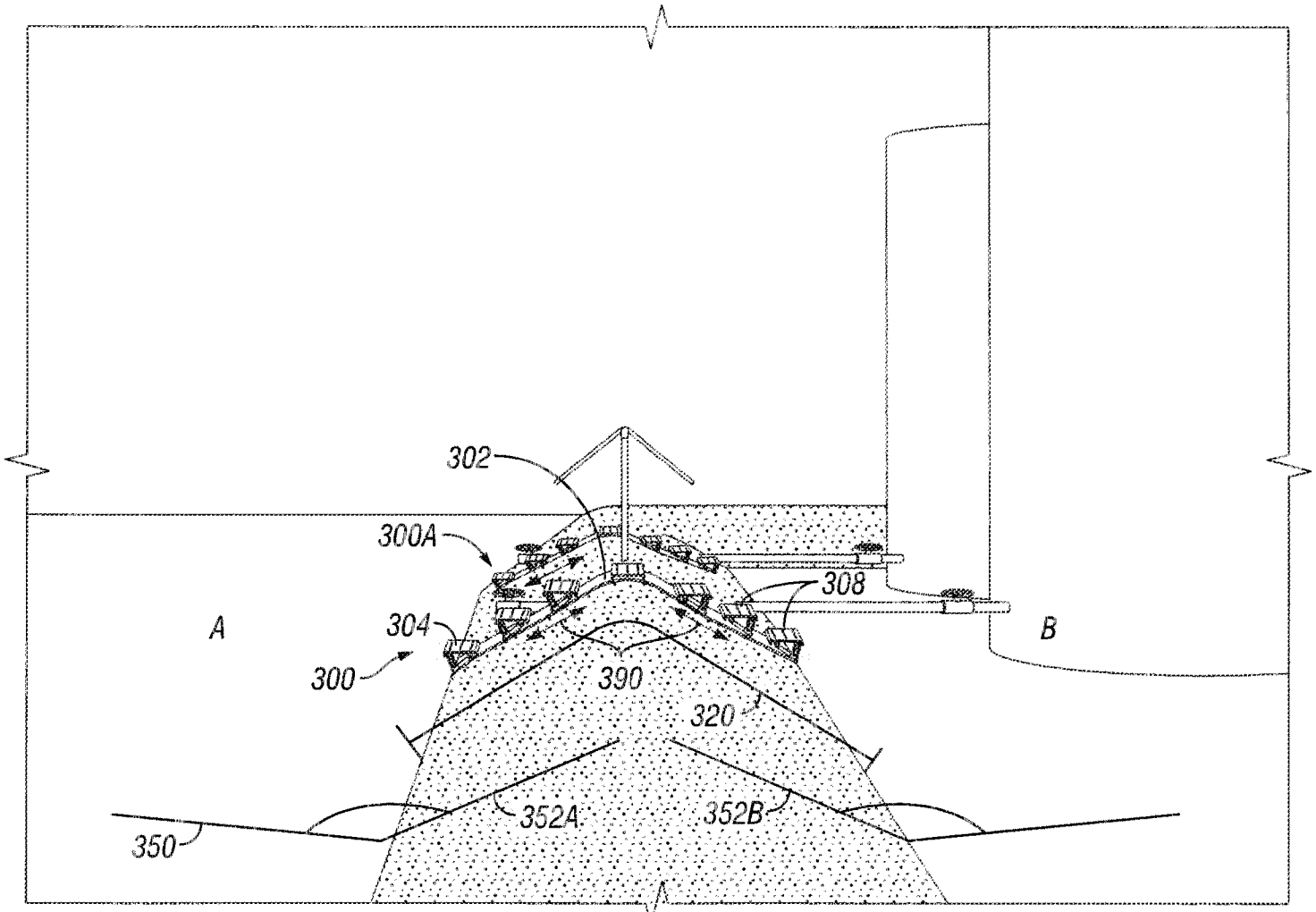

Referring now to FIGS. 3A and 3B, a front view and side perspective view, respectively, of a portable pathway apparatus 300 disposed on a surface according to embodiments of the present disclosure, is shown. Like the portable pathway 200 previously described, the portable apparatus 300 may be used to provide a traversable pathway over a surface 310. The apparatus 300 may include similar components and materials of construction as described for apparatus 200, such that apparatus 200 and apparatus 300 may be similar, however, apparatus 200 and apparatus 300 are not necessarily identical.

The portable apparatus 300 may be constructed of a number of interconnected components and subcomponents, such as frame member 302. The frame member 302 may be made of a durable material configured to withstand extreme environments, such as harsh weather conditions, continuous usage, heavy wear-and-tear, etc. Although the apparatus 300 may just as well include a frame member of a rigid construction, such as one or more connected steel pieces, the portable pathway apparatus 300 may generally be considered to have a one piece pliable frame member 302 configured so that the apparatus 300 may readily conform to contours of the surface 310 where the apparatus 200 may be placed thereon.

As such, the frame member 302 may thus include physical properties associated with at least some durability and toughness, but also flexibility and conformability. The frame member 302 may include at least one step 304 sturdily and/or adjustably connected thereto, as well as at least one securing element (not shown) that may be coupled with the frame member 302, whereby the apparatus 300 may be securely connected to the surface 310.

The frame member 302 may provide the apparatus 300 with the ability to distribute forces. For example, when an operator (not shown) steps onto the bare surface 310, the pressure is applied to the surface 310 directly at the operators step. In comparison, when the operator steps onto the apparatus 300, the pressure of the step may be distributed across the frame member 302, such that pressure applied to the surface 310 at the point of the step is minimal or marginalized, and instead the forces are distributed across the area of the frame member surrounding the operator's step.

In addition to a single step 304, there may be one or more additional steps 308 connected to the frame member 302, such that the pathway apparatus 300 has a plurality of steps 304 and 308. In some embodiments, any of the steps 304 and/or 308 may be independently adjustable, while in other embodiments each one of the steps 304 and 308 may be independently adjustable. There may be a plurality of steps 304, 308 spaced equidistantly, as indicated by spacing arrows 390, however, it is not necessary that this is the case for each and every step. As such, some steps 304, 308 may be spaced equidistantly from others, while other steps 308 are spaced apart by varying distances.

As shown in FIGS. 3A and 3B together, the portable pathway apparatus 308 may be configured to provide a pseudo "mirror image" pathway over a barrier 324. In this aspect, the step(s) 304 and/or 308 may be adjusted by provide a planar step up a first angled surface 352A, while other steps 304 and/or 308 may be adjusted to provide planar steps up a second angled surface 352B. As such, the apparatus may have steps 304 and/or 308 unevenly and/or unsymmetrically spaced and/or disposed along the frame member 302.

The surface 310 upon which the pathway apparatus 300 may be applied against may be any kind of surface that may at some point require walking upon or traversing. While the surface 310 may be a generally flat earthen surface, such as the ground, the earthen surface may include a mound, hill, or other comparable contour. As shown in FIGS. 3A and 3B, the surface 310 may be a man-made earthen barrier 324. As such, it would be apparent to one of skill in the art that the apparatus 300 may be used on the surface 310 that may be thought of as a naturally existing barrier, as well as the man-made barrier 324.

While physical dimensions of the apparatus 300 are not significant to the disclosure, certain embodiments may be described with dimensions in order to provide a reader with a general reference. A horizontal member (444, FIG. 4) may be a 20" galvanized step. The horizontal member (444, FIG. 4) may be adjusted to change the level of the member with respect to a planar surface 350. In an embodiment, the level of the step may be adjusted between a range of about 20 to 70 degrees.

Figure 5A:
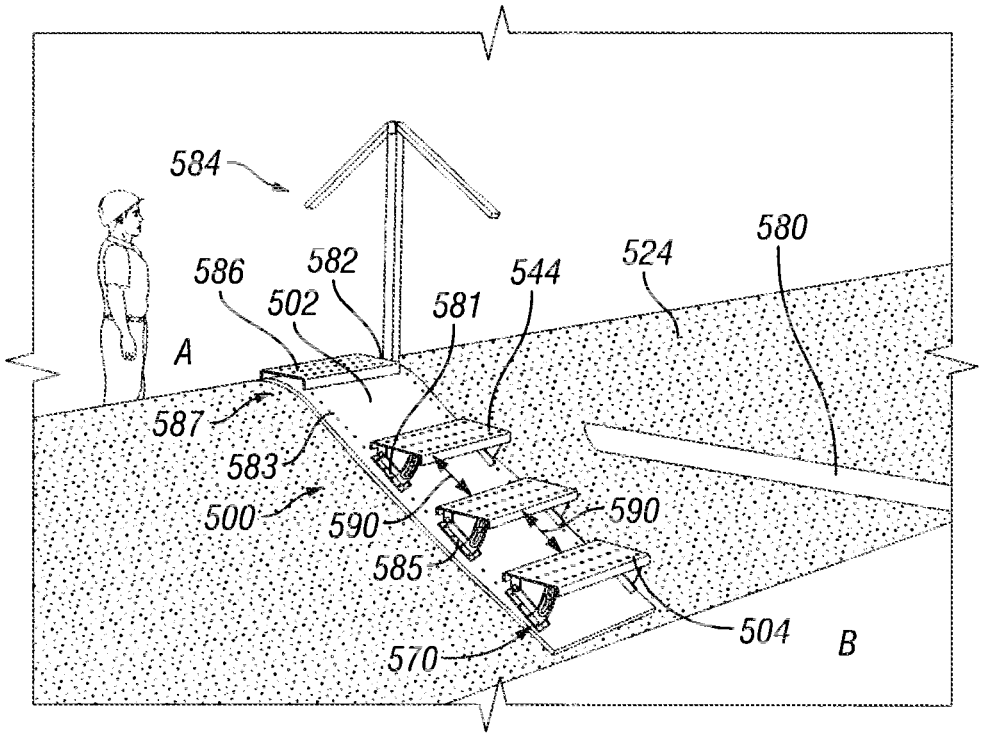
FIGS. 5A, 5B, and 5C show various views of a portable pathway apparatus used in conjunction with a tank farm, in accordance with embodiments of the present disclosure.
Figure 5B:
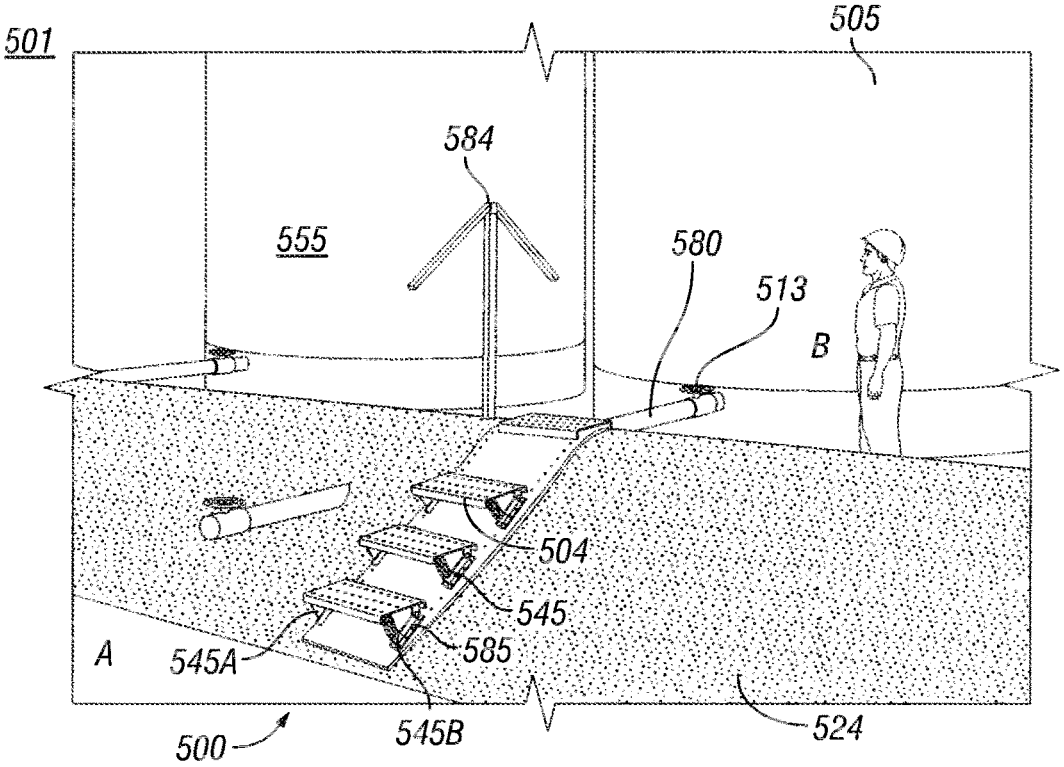
Figure 5C:
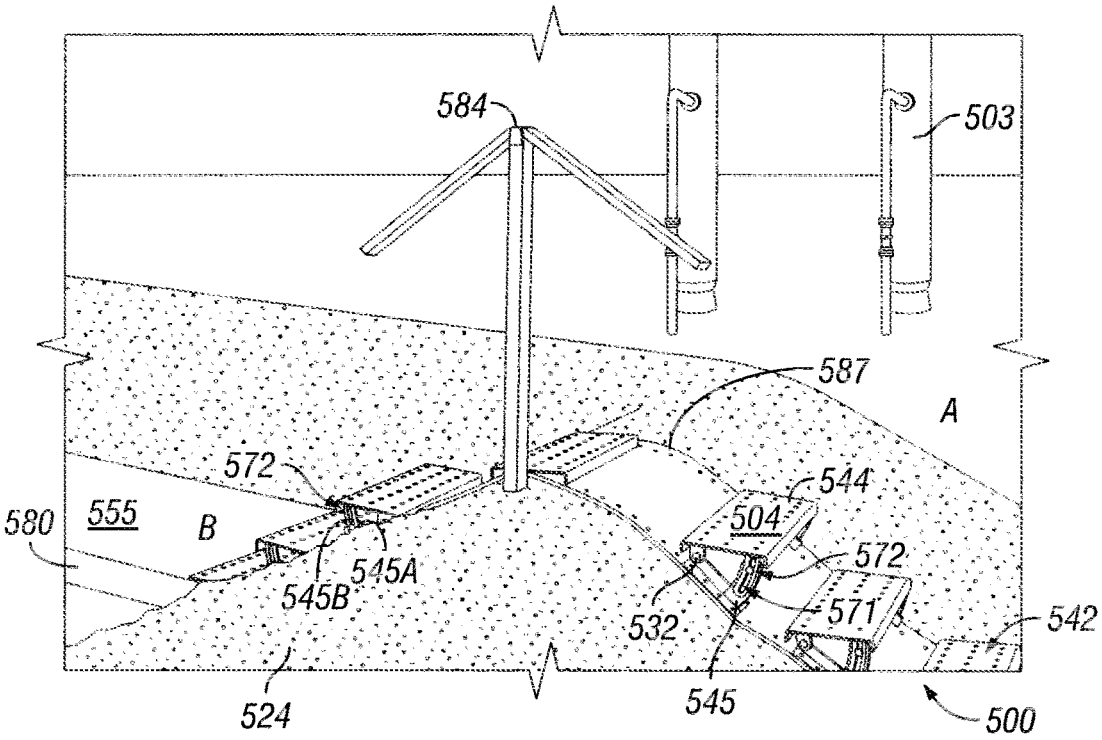

Referring now to FIGS. 5A, 5B, and 5C, various views of a portable pathway apparatus 500 used in conjunction with a tank farm according to embodiments of the present disclosure, are shown. Like the portable pathways 200 and 300 previously described, the portable apparatus 500 may be used to provide a traversable pathway over a surface, such as a barrier 524. As such, the apparatus 500 may include similar components and materials of construction as described for apparatuses 200 and 300, such that apparatus 500 may be similar to those previously discussed, but does not necessarily have to be identical.

Accordingly, apparatus 500 may be part of a tank farm system 501 located in part of a petrochemical facility 503, whereby system 501 may include an ingress and/or egress pathway to a tank farm 555. Because of the potential that tanks 505 may leak, the barrier 524 may be emplaced or built around tanks 505 in order to form a perimeter therearound. In order to add or remove fluids from one or more of the tanks 505, such as via piping 580, a valve 513 may require actuation.

An operator 511 may traverse the barrier 524 from point A to point B by walking over the portable pathway 500. In order to provide the best pathway, the apparatus 500 may be optimized by adjusting one or more steps 504 that may be movingly disposed on a frame member 502. The frame member 502 may be made of a durable material configured to withstand extreme environments, such as weather conditions, continuous usage, heavy wear-and-tear, etc. As illustrated, the frame member 502 may be pliable, such that the frame member 502 may readily conform to any contours or other non-uniform/uneven surfaces of the barrier 524.

The frame member 502 may include the one or more steps 504 sturdily and/or adjustably connected thereto, as well as at least one securing element (406, FIG. 4) that may be coupled with the pliable frame member 502, and securely fastened to the barrier 524. As such, the at least one securing element may be configured to secure the portable pathway 500 to the barrier 524.

As illustrated in FIGS. 5A-5C together, the apparatus 500 may include a plurality of steps 504. In some embodiments, any of the steps 504 may be independently adjustable, while in other embodiments each one of the steps 504 may be independently adjustable. There may be a plurality of steps 504 spaced equidistantly from one another, as indicated by spacing arrows 590, however, it is not necessary that this is the case for each and every step. As such, some steps 504 may be spaced equidistantly from others, while other steps 504 are spaced apart by varying distances.

The operator 511 may obtain substantially planar steps 504 by adjusting one or more of corresponding adjustment mechanisms 570. As such, the step(s) 504 may include a number of other subcomponents, including subcomponents that may provide the step 504 with the ability to adjustably connect to the frame 502. For example, the step 504 may include various linking members 545. As shown, there may be an upper linking member 545A movingly (e.g., slidingly, telescopingly, etc.) engaged with a lower linking member 545B. As such, the upper linking member 545A may be securely attached to a horizontal member 544, while the lower linking member 545B may be securely attached to mount 585. The linking members may be attached to other components by common attachments, such as bolted, riveted, welded, integrally formed, etc.

Although any of the linking members 545 may have structural differences, the linking members 545 may just as well be substantially similar, other than the location where the linking member 545 is located on the apparatus 500. Linking members 545 may include a number of variations, which may include apertures and/or slots. As shown, the lower linking member 545B may include a slot 571, while upper linking member 545B may include a protrusion 572 that corresponds with the slot 571 for adjustably moving therein. The protrusion may be, for example, a bolt or the like that may be loosened, such that the bolt may move up and down in the slot 571 until the member 544 is in the desired position. Once the member 544 is in the desired position, the bolt may be tightened, such as with a corresponding nut, or with any other tightening device as would be known to one of ordinary skill in the art.

Although described as a bolt, the protrusion 572 may be screws, nails, or other fastener devices that may be used to fix the relationship of the linking members 545A and 545B so that the level of the member 544 may be adjusted to its desired position.

The horizontal member 544 may also pivotablly connect with mount 585, such as via a pin or other hinge device 532. The pin 532 may be, for example, inserted into corresponding apertures (not shown) of the member 544 and mount 585, respectively. In addition, mount 585 may have a mating connection 581, such that the mount 585 may be used to provide coupling between the step 504 and the frame 502. Although connection 581 is shown as external, the mount 585 may be disposed within the frame 502. In some embodiments, the mount 585 may be integral with the frame 502.

The connection 581 may be the result of mating holes 583 disposed within the frame member 502. As shown, there may be one or more rows of mating holes disposed on along one or both sides of the frame member 502. Any of the steps 504 and/or 508 may couple to the frame member 504 via connectors disposed through mount 585 and holes 583, which may be, for example, carriage bolts or the like, thereby forming connection 581. As mentioned, the placement holes 583 may be used for adequately spacing steps 504 and/or 508 apart from each other, as desired or needed.

In some embodiments, the barrier 524 may have a crested portion 587. As such, the apparatus 500 may include a non-adjustable step, shown in FIG. 5A as a top or intermediate step 582. The intermediate step 582 may include a horizontal member like the previously described horizontal member 544.

As shown, a handrail 584 may also be used in conjunction with the pathway apparatus 500. In some embodiments, the handrail 584 may be coupled with the apparatus 500, while in other embodiments the handrail 584 may be securely mounted to the barrier 524 in a location adjacent to where the pathway 500 is placed.

The handrail 584 may be, for example, pivotally coupled to the apparatus 500 by coupler 582, which may be a hinge-type mechanism. With a pivotal coupling, the handrail 584 may be positioned upright and securely locked in place with respect to the frame 502, as would be known to one of ordinary skill in the art. Regardless of whatever handrail 584 configuration may be desired, the handrail 584 may retain proper relationship to the portable pathway 500.

In conjunction with the figures, embodiments disclosed herein may include a method of providing a traversable path along a surface. The method may include various steps, such as a user placing a portable pathway apparatus 200 onto the surface 210. The portable pathway apparatus may include at least one adjustable step connected thereto, which may make it easier to traverse (e.g., walk, climb, navigate, etc.) over the provided path. For example, the apparatus 200 may be placed on a steep terrain or other contour, such as a rooftop, whereby the presence of one or more steps may make it easier to climb or walk thereon.

The portable apparatus may also include, for example, a pliable frame member 202 coupled with the at least one adjustable step 204, and a securing element 206 coupled with the pliable frame member 202. When necessary or desired, the method may include the step of adjusting one or more of the steps to a desired position.

The method may include the step of securing the portable pathway 200 wherever the pathway is needed, such as by inserting securing elements 206 into the surface 210. As such, the portable pathway apparatus may be secured in situ.

The method may include securing the pathway to a surface that may be an earthen surface having at least one angled contour. In one embodiment, the portable pathway may be placed substantially symmetrically over one or more angled contours or surfaces. In another embodiment, the surface may include a manmade surface.

The method may include the portable pathway having a plurality of additional adjustable steps connected thereto, wherein each of the steps is independently adjustable. As such, the method may include the step of adjusting at least one of the steps until a base of the at least one adjusted step is substantially planar to a horizontal surface. In other embodiments, the method may include the step of adjusting every one of the steps until every adjusted step has a base that is substantially planar to a horizontal surface.

From the above description, it can be seen that a portable, adjustable pathway is provided for use in temporary or permanent applications. The portable apparatus is beneficially durable for long-term use, but readily movable if necessary. The portable apparatus is particularly advantageous for situations where surfaces have angles associated therewith that make the surface difficult to traverse. Beneficially, the portable apparatus may be used in residential, industrial, and recreational areas.

The portable apparatus may beneficially be sized to any length or width as necessary to provide a traversable path. The lightweight design means the portable apparatus may be easily moved or transported. Any number of adjustable steps may be added. Particularly beneficial is the fact that the portable apparatus may be used on any surface, such as man-made surfaces or natural terrains.

The portable apparatus may be placed in areas to prevent damage to barriers and other comparable structures, without affecting barrier integrity. Beneficially, steps of the apparatus may be adjusted to allow the apparatus to be used effectively on any contoured surface. The portable apparatus may advantageously take advantage of "green" technology because the apparatus may be manufactured from various recycled or waste materials. In addition, the apparatus may include non-flammable materials, such that the apparatus will prevent the transfer or transmission of fire outside of a barrier. As mentioned, the frame member may thus include physical properties associated with at least some durability and toughness, but also flexibility and conformability. The frame member may advantageously be capable of withstanding forces under all kinds of circumstances and environmental conditions, often for a prolonged period of time without need for replacement or repair.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A tank farm system comprising:

a tank configured to hold a volume of fluid;

a barrier constructed at least partially around the tank; and a portable pathway disposed on the barrier, the portable pathway further comprising:

a pliable frame member;

a row of mating holes disposed on each side of the pliable frame member;

a set of steps coupled to the pliable frame member;

wherein one or more of the set of steps is coupled to the pliable frame member with a corresponding set of mounts that align with the row of mating holes on each of the corresponding sides of the pliable frame member, wherein the mount on each side is movable along a length of the pliable frame member, wherein at least one step of the set of steps comprises a pivotably, adjustment mechanism, wherein the portable pathway further comprises at least one securing element coupled with the pliable frame member, and wherein the securing element is configured to secure the portable pathway to the barrier.

2. The system of claim 1, wherein at least one of the set of steps comprises galvanized metal, and wherein the barrier comprises a man-made earthen surface.

3. The system of claim 2, wherein the barrier further comprises a first angled surface with respect to a horizontal and a second angled surface with respect to the horizontal, and wherein the portable pathway is disposed at least partially on the first angled surface and the second angled surface.

4. The system of claim 2, wherein the barrier further comprises a crest, and wherein the adjustment mechanism comprises a first linking member movingly connected with a second linking member.

5. The tank farm system of claim 4, wherein the portable pathway comprises a non-adjustable step, and wherein the position of the pathway on the barrier results in the non-adjustable step being proximate to a barrier crest.

6. A tank farm system with improved ingress and egress, the system comprising:

a tank configured to hold a volume of fluid;

a barrier proximate to the tank, the barrier comprising a first surface contour and a second surface contour; and a portable pathway configured to conform to the first surface contour and the second surface contour, the pathway further comprising:

a pliable frame member having a plurality of pivotably, adjustable steps coupled thereto;

wherein the at least one step is coupled to the frame member by a mount on each side of the at least one step, and wherein the mount on each side is movable along a length of the frame member, wherein the barrier comprises a man-made earthen surface, wherein the first surface contour comprises a first angled surface with respect to a horizontal, and the second angled contour comprises a second angled surface with respect to the horizontal, and wherein the portable pathway is disposed at least partially on the first angled surface and the second angled surface.

7. The tank farm system of claim 6, the portable pathway is configured with an equal amount of steps disposed proximate to each of the first angled surface and the second angled surface, and wherein the portable pathway comprises a non-adjustable middle step disposed between the steps disposed proximate to the first angled surface and the second angled surface.

8. The tank farm system of claim 7, wherein the first angled surface is at an angle in the range of about 20 to about 70 degrees with respect to the horizontal, wherein the second angled surface is at an angle in the range of about 20 to about 70 degrees with respect to the horizontal.

9. The tank farm system of claim 6, wherein the portable pathway comprises a row of mating holes on a first and second side of the pathway, and wherein connectors are configured for connecting each of the respective mounts to the pathway via insertion into the desired mating holes.

10. A tank farm system comprising:

a tank;

a barrier constructed at least partially around the tank, the barrier further comprising an earthen surface having a first angled surface with respect to a horizontal and a second angled surface with respect to the horizontal; and a portable pathway disposed on the barrier, comprising:

a pliable frame member; a set of steps; and a plurality of mounts, each configured to couple a respective step to the pliable frame member, wherein at least one of the set of steps is movable along a length of the pliable frame member, wherein the portable pathway is disposed at least partially on the first angled surface and the second angled surface, wherein the set of steps comprises an equal amount of steps on the first angled surface and the second angled surface, wherein the portable pathway comprises a non-adjustable middle step disposed between the steps on the first angled surface and the second angled surface, wherein the first angled surface is at an angle in the range of about 20 to about 70 degrees with respect to the horizontal, wherein the second angled surface is at an angle in the range of about 20 to about 70 degrees with respect to the horizontal, wherein each step of the set of the steps comprise a first linking member movingly engaged with a second linking member, and wherein each step of the set of the steps comprise a horizontal member pivotably coupled to a respective mount.

11. The tank farm system of claim 10, the system comprising a plurality of tanks, and wherein at least one pipeline extends from one of the plurality of tanks through the barrier.

12. The tank farm system of claim 10, wherein the portable pathway further comprises a row of mating holes disposed on each side of the pliable frame member, wherein one or more of the set of steps is coupled to the pliable frame member with the respective mount that aligns with the row of mating holes on each of the corresponding sides of the pliable frame member.

* * * * *